US007866915B2

(12) United States Patent
Pendleton et al.

(10) Patent No.: US 7,866,915 B2
(45) Date of Patent: Jan. 11, 2011

(54) COVERING FOR AN ACCESS APERTURE, AND RELATED ASSEMBLIES

(75) Inventors: Alan Jack Pendleton, Melton Mowbray (GB); John Neil Pickavance, Bingham (GB)

(73) Assignee: Saint-Gobain Pam, Nancy (FR)

( * ) Notice: Subject to any disclaimer, the term of this patent is extended or adjusted under 35 U.S.C. 154(b) by 836 days.

(21) Appl. No.: 10/585,076

(22) PCT Filed: Dec. 29, 2004

(86) PCT No.: PCT/GB2004/005448

§ 371 (c)(1),
(2), (4) Date: Jan. 4, 2007

(87) PCT Pub. No.: WO2005/064089

PCT Pub. Date: Jul. 14, 2005

(65) Prior Publication Data

US 2007/0154259 A1 Jul. 5, 2007

(30) Foreign Application Priority Data

Dec. 31, 2003 (GB) ..... 0330271.8

(51) Int. Cl.
*E02D 29/14* (2006.01)

(52) U.S. Cl. ..... 404/25

(58) Field of Classification Search ..... 404/25, 404/26; 52/19, 20; 137/371
See application file for complete search history.

(56) References Cited

U.S. PATENT DOCUMENTS

| | | | | |
|---|---|---|---|---|
| 284,203 | A * | 9/1883 | Herr | 404/25 |
| 1,799,489 | A * | 4/1931 | West | 404/25 |
| 2,056,362 | A * | 10/1936 | Moore | 404/25 |
| 2,997,932 | A * | 8/1961 | Taylor | 404/26 |
| 3,521,537 | A * | 7/1970 | Forni et al. | 404/25 |
| 4,508,469 | A * | 4/1985 | Dumortier | 404/25 |
| 5,595,455 | A * | 1/1997 | Svirklys | 404/25 |
| 5,732,512 | A * | 3/1998 | Ueno et al. | 52/19 |
| 5,769,564 | A * | 6/1998 | Hawkins | 404/25 |
| 5,832,674 | A * | 11/1998 | Ledbetter et al. | 52/58 |
| 6,116,813 | A * | 9/2000 | Pate | 404/25 |
| 6,276,093 | B1 * | 8/2001 | Janesky | 52/19 |
| 6,749,363 | B1 * | 6/2004 | Petersen | 404/25 |

(Continued)

FOREIGN PATENT DOCUMENTS

DE 29 06 085 8/1980

(Continued)

OTHER PUBLICATIONS

U.S. Appl. No. 11/813,147, filed Jun. 29, 2007, Pickavance, et al.

*Primary Examiner*—Gary S Hartmann
(74) *Attorney, Agent, or Firm*—Oblon, Spivak, McClelland, Maier & Neustadt, L.L.P.

(57) ABSTRACT

A covering (10), for an access aperture, comprises a pair (11, 12) of cover plates, of unequal sizes, that are positionable one adjacent the other along a line of juxtaposition (14) to define a generally rectangular covering. The line of juxtaposition (14) extends from one side (24) of the generally rectangular covering to another (26) and is spaced from the diagonal (27) of the rectangular covering that it is proximate.

17 Claims, 6 Drawing Sheets

U.S. PATENT DOCUMENTS

2005/0025571 A1* 2/2005 Nicks ..... 404/25

FOREIGN PATENT DOCUMENTS

GB 1 125 870 9/1968
GB 2 262 557 A 6/1993
GB 2 315 793 A 2/1998
GB 2 388 863 11/2003

* cited by examiner

COVERING FOR AN ACCESS APERTURE, AND RELATED ASSEMBLIES

BACKGROUND OF THE INVENTION

This invention relates to a covering for an access aperture, and related assemblies.

DESCRIPTION OF THE RELATED ART

Access apertures, which include but are not limited to manholes, are commonly formed in e.g. roadways, floors, bridge decks, car parks, shopping centres, playgrounds and pavements.

A known covering 10 for a manhole includes a pair 11, 12 of cover plates as shown schematically in underneath plan view in FIG. 1. The cover plates are manufactured typically from cast iron or from steel.

In FIG. 1 a rectangular aperture is bounded by a cast iron or steel frame 13 in which the cover plates 11, 12 are receivable lying side by side along a line of juxtaposition 14 defined by edges of the respective cover plates. In use the plates lie horizontally. When so located the cover plates close off the aperture defined by the frame 13.

The cover plates 11, 12 visible in FIG. 1 are identical to one another, at least when viewed (as in FIG. 1) from underneath.

Each is in plan a triangle whose shape is modified slightly by reason of the line of juxtaposition 14 crossing a diagonal of the rectangular aperture so as to intersect opposite edges of the rectangular aperture, a short distance from respective corners of it. Thus each cover plate 11, 12 resembles a triangle one of whose apices has been cut off along a line 16 lying parallel to an unadjacent side 17 of the triangle.

The use of essentially triangular cover plates 11, 12 is associated with well known advantages.

Principal among these is that triangular cover plates can easily be made "non-rocking". In other words, it is readily possible to arrange the triangular cover plates each to contact the frame 13 at three points. An object supported at three spaced locations will normally remain inherently stable even if the points of contact wear unevenly.

A metal cover plate supported in this way is considerably less likely to become noisy in use, as e.g vehicles and/or pedestrians pass over it, than a cover plate supported for example at four spaced locations.

In practice the non-rocking nature of manhole and other access aperture cover plates is achieved through the inclusion of three protuberances located on the underside of each cover plate, approximately at the apices of the triangles defined by the plates. When the covers 11, 12 are inserted into the frame the protuberances engage formations on the frame 13 to support the covers.

The triangular cover plates 11, 12, are necessarily robust, especially when made of cast iron. A pair of cast iron plates designed to fill a 600 mm by 600 mm square aperture as shown in FIG. 1 together weigh about 50 kg.

Since the principal purpose of the cover plates is to permit inspection of and/or access via the aperture, the cover plates are frequently manually lifted, removed and subsequently replaced.

The repeated lifting of heavy metal plates may cause spinal and other injuries to workers who have to open manholes. Such activities also are occasionally hazardous simply because of the risk of injury should the plates be accidentally dropped. This risk exists even when, as is often nowadays the case, the cover plates are hingedly secured to the frame to facilitate their opening.

SUMMARY OF THE INVENTION

According to a first aspect of the invention there is provided a covering, for an access aperture, comprising at least a pair of cover plates, of unequal sizes, that are positionable one adjacent the other along a line of juxtaposition to define at least part of the covering, the larger of the said pair of cover plates including one or more primary strengthening members and at least a first, auxiliary strengthening member of the covering, and the smaller of the said pair of cover plates including a lesser number of primary strengthening members than the larger cover plate; or omitting a said primary strengthening member.

The use of two cover plates of unequal sizes; and the inclusion of a (large) primary strengthening rib on only one of the cover plates mean that one of them is lighter than the other (assuming, as is normally the case, that both the cover plates are made from the same material). The lighter of the two cover plates therefore is more readily liftable than the heavier one, thereby facilitating the kinds of access via the aperture that do not require its complete opening.

Preferably the smaller of the pair of cover plates includes one or more auxiliary strengthening members. Therefore the smaller cover plate of the said pair contributes to the overall strength of the covering.

The or each strengthening member preferably includes an elongate rib protruding from the in-use underside of a said cover plate. Although this is the preferred way of embodying the strengthening members according to the invention, other arrangements are also possible.

Conveniently the said primary strengthening member extends generally parallel to the said line of juxtaposition. Also preferably the primary strengthening member lies closer to the said line of juxtaposition than to any other edge of the larger of the pair of cover plates. When, as in the preferred embodiment of the invention, the cover plates of the said pair are both triangular, this arrangement confers good rigidity while minimising the mass of metal constituting the covering.

In one embodiment of the invention there are provided three or more of the cover plates. Such an arrangement preferably includes one or more further lines of juxtaposition along which at least one respective pair of cover plates are positionable one adjacent the other.

It is also preferable that the cover plates, when positioned one adjacent the other along one or more lines of juxtaposition as appropriate, define a rectangular covering. Thus the covering may consist of one or more pairs of eg. triangular or rectangular cover plates; or it may include combinations of different cover plate shapes, such as parts of a circle.

Preferably the covering includes a line of juxtaposition that is a straight line intersecting two adjacent sides of the rectangular covering defined by the cover plates.

In particularly preferred embodiments of the invention there is provided a line of juxtaposition that intersects a diagonal of the rectangular covering. Alternatively there is provided a line of juxtaposition that is spaced from the diagonal, of the rectangular covering, that it is proximate.

More generally the line of juxtaposition is a straight line that intersects two adjacent sides of the rectangular covering.

The foregoing features have been found to confer good strength, and comparative lightness, on embodiments of the invention.

When the covering defined by the cover plates is rectangular, preferably the smaller of the cover plates is triangular when viewed in plan; and the larger one preferably is a fivesided figure having four sides perpendicular to one another; and its fifth side interconnecting at angles two of the aforesaid sides.

Conveniently the larger of the pair of cover plates includes two reinforcing protrusions; and the smaller of the pair includes a single said protrusion.

For a given size of covering this arrangement results in fewer reinforcing protrusions overall than in the cover plates of FIG. 1 which, by reason of being identical, each have the same number of the protrusions.

Consequently the covering of the invention requires less effort to lift, remove and replace than the prior art covering.

Conveniently the covering includes a connection securing the cover plates one to the other. This connection preferably permits pivoting of the plates along the line of juxtaposition.

Consequently one, typically the smaller, plate is easily openable from its closed position by hinging it about the line of juxtaposition.

As an alternative there is provided a connection, between the plates, that is a so-called "loose connection", being a type of connection that is per se known in the manhole design art.

The invention also resides in a surface access assembly including a frame defining the boundary of an aperture; and a covering as defined hereinabove, the covering being moveably receivable in the frame so as to permit closing and opening of the aperture.

Also preferably the assembly includes a hinge pivotably securing one of the cover plates to the frame.

Consequently when forming part of an assembly one, eg. the larger, of the cover plates also is easily openable from a closed position, by hinging it about an edge of the frame.

In a preferred embodiment of the invention the frame and each said cover plate engage one another at three mutually spaced locations so as to define a non-rocking support for each cover plate. Thus the known advantages of non-rocking supports for the cover plates inure to the arrangements of the invention.

It is also preferable that when the said aperture is rectangular the direction of elongation of the primary strengthening member generally coincides with a diagonal of the rectangular aperture.

This ensures that the larger of the cover plates is reinforced adjacent its longest edge, thereby maximising its strength.

BRIEF DESCRIPTION OF THE DRAWINGS

There now follows a description of a preferred embodiment of the invention, by way of non-limiting example, with reference being made to the accompanying drawings in which.

DETAILED DESCRIPTION OF THE PREFERRED EMBODIMENTS

Figure 2:
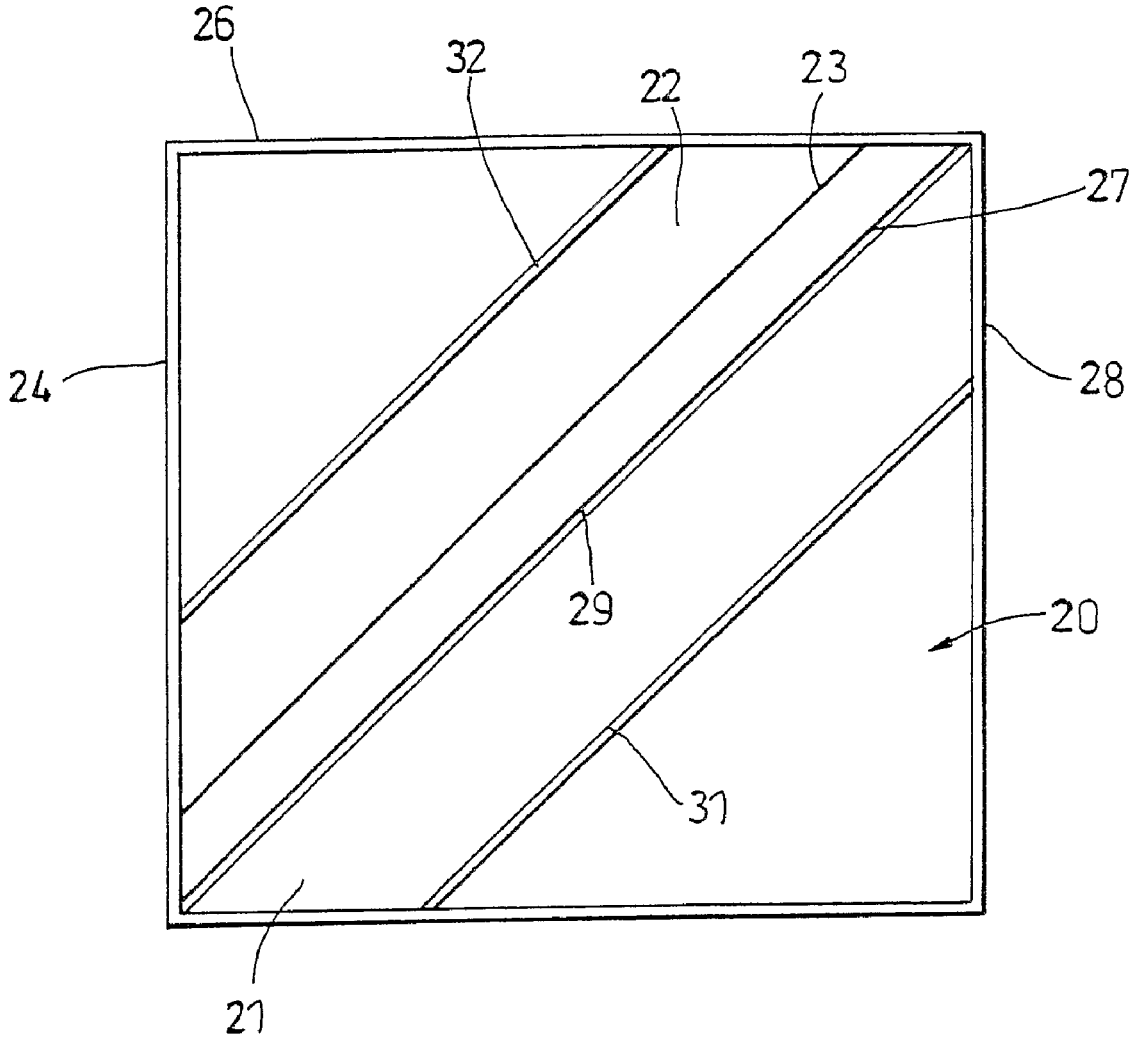
FIG. 2 is a schematic, underneath plan view of an assembly according to the invention incorporating a covering according to the invention.
Figure 3:
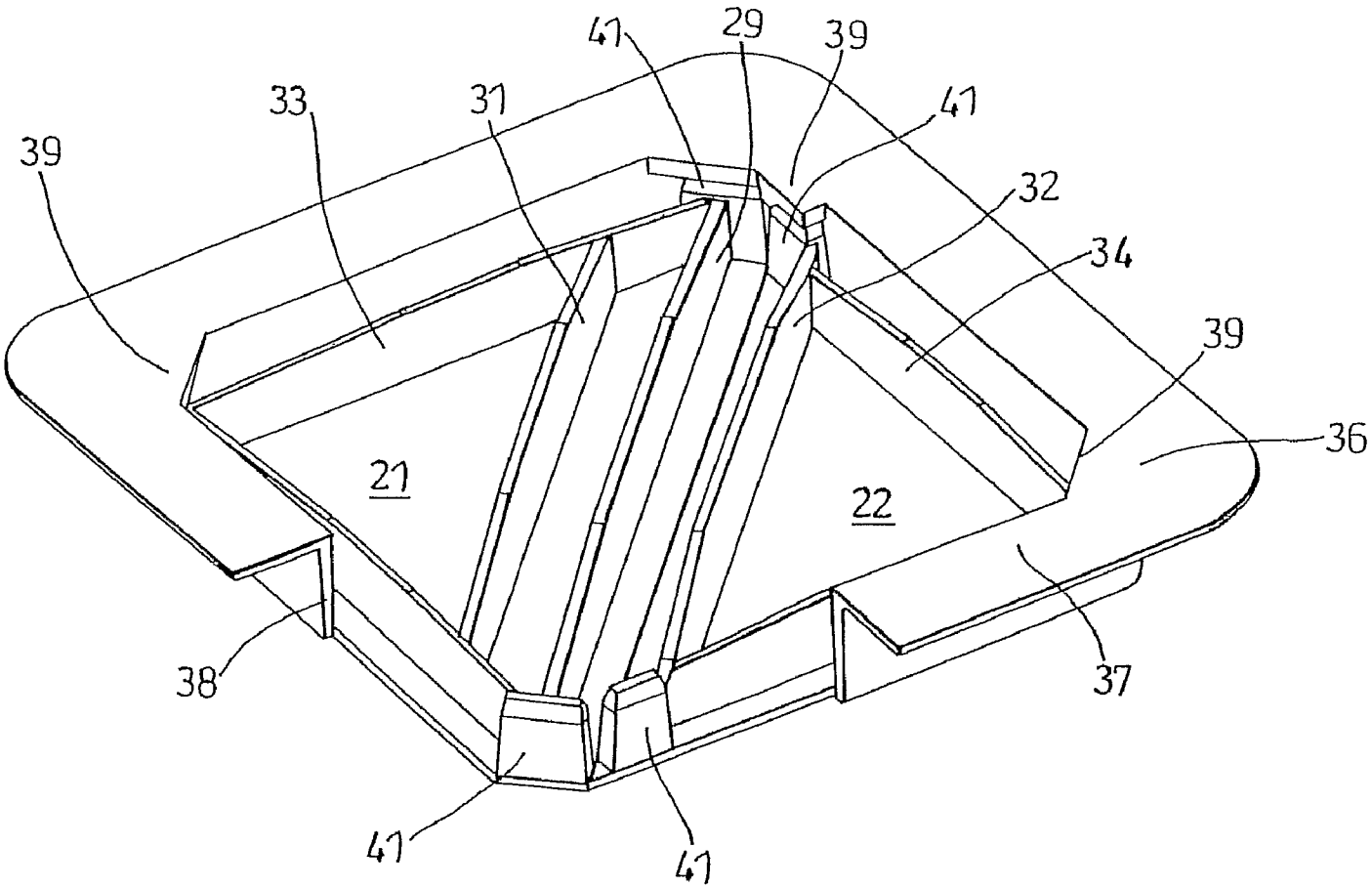
FIG. 3 is a perspective, partly cut away representation of the underside of the arrangement of FIG. 2.

FIGS. 2 and 3 illustrate the main principles of the invention.

In FIGS. 2 and 3 a covering 20 for an aperture such as a manhole includes a pair of cover plates 21, 22 that are of unequal sizes. In the embodiment shown the cover plate 21 is considerably larger than the plate 22.

The plates 21, 22 are manufactured e.g from cast iron, especially so-called "ductile iron"; or steel.

When placed side by side along a line of juxtaposition 23 the plates 21, 22 define a generally rectangular covering 20 when viewed in plan.

In the embodiment shown the cover plates 21, 22 define a square. In other embodiments other rectangles, and indeed non-rectangular shapes, are possible.

The line of juxtaposition extends from a first side 24 of the thus-defined rectangle to an adjacent side 26 proximate but spaced from a diagonal 27 of the rectangle.

Thus in the embodiment shown the line of juxtaposition, that may also be thought of as a line along which the cover plates separate when one of them is moved relative to the other, does not cross the proximate diagonal of the rectangle.

Such crossing of the diagonal is however possible within the scope of the invention, whereby the line of juxtaposition could intersect a third side 28 of the rectangle that is opposite side 24. The arrangement shown is nonetheless preferred.

As noted the use of cover plates 21, 22 of unequal sizes confers on the covering of the invention very significant advantages in terms of ease of use.

The cover plates include several strengthening members in the form of reinforcing protrusions. The larger cover plate 21 includes more of them than the smaller cover plate 22.

More specifically the larger cover plate 21 includes protruding from its underside two in-use downwardly extending, elongate ribs 29, 31. The smaller cover plate 22 includes a single such rib 32. Typically the ribs 29, 31, 32 are cast into the undersides of the cover plates.

In the preferred embodiment shown the ribs 29, 31, 32 are mutually parallel and extend parallel to the diagonal 27 of the rectangle defined when the cover plates 21, 22 lie adjacent as shown. Furthermore the elongate rib 29, that is the primary strengthening member of the larger cover plate of the pair, coincides with the said diagonal 27 so as to reinforce the longest span of the larger cover plate 21 when the latter is supported across an aperture.

Although the ribs 29, 31 shown are straight when viewed in plan, other shapes are possible within the scope of the invention. For example curved ribs are possible, as are eg. "arrow head" shaped ribs.

Rib 29, being the primary strengthening member, is dimensioned and located so as to provide a very significant proportion of the strengthening of the covering 20.

Thus for example rib 29 is larger and longer than the ribs 31 and 32, which latter therefore act as auxiliary strengthening members.

Such an arrangement, in which the number of primary strengthening members formed on the larger cover plate is greater than the number of primary strengthening members formed on the smaller cover plate, confers very good strength and lightness properties on the covering 20.

Although in the embodiment of FIG. 2 the larger cover plate 21 includes one primary strengthening member and the smaller cover plate 22 omits strengthening members entirely, it is possible to provide other numbers of the strengthening members if desired. Thus for example it is possible within the scope of the invention to provide two strengthening members on the larger cover plate 21 and a further, primary strengthening member on the cover plate 22.

As is visible in FIG. 3, each cover plate 21, 22 includes a downwardly depending peripheral wall 33, 34 that is present to provide further reinforcement. Each rib 29, 31, 32 intersects and is secured to a said peripheral wall 33, 34 thereby providing a particularly robust structure.

However other arrangements of the ribs are possible. For example they need not be mutually parallel, the invention being embodied simply by virtue of the use of non-identical cover plates that by including "asymmetric" arrangements of strengthening members (as described herein) reduce the number of ribs needed.

In other words, although in the preferred embodiment of the invention the inequality of the sizes of the cover plates is evident from a plan view of the manhole assembly, this need not necessarily be so. On the contrary, the inequality may be the result of eg. different numbers or sizes of ribs on the undersides of the two cover plates; the plan views of the cover plates from above being substantially or completely identical.

The cover plates 21, 22 are in the embodiment shown secured one to the other by a connection in the form of a hinge that permits pivoting of the cover plates relative to one another about the line of juxtaposition.

An assembly according to the invention includes, as shown eg. in FIG. 3, a rectangular frame 36 that also is manufactured from cast iron or steel. In FIG. 3 the frame 36 is for ease of illustration inverted compared with its in-use orientation.

Frame 36 is square in the embodiment shown, although other shapes (including but not limited to non-square rectangles) are possible within the scope of the invention.

Frame 36 includes at its lowermost extent a rectangular, peripheral flange 37. In use the flange is embedded in a bedding medium, especially a mortar, in a road or similar surface as mentioned hereinabove, thereby securing the frame 36 relative to the surface.

Upstanding from flange 37 is a rectangular wall 38 that defines the mouth of the aperture requiring closing by the covering according to the invention. The cover plates 21, 22 are insertable into the space bounded by the wall 38 to close off the aperture as desired.

At locations adjacent the corners of the rectangle defined by the wall 38 the frame 36 includes four shaped shoulders 39, three of which are visible in FIG. 3 and one of which is obscured by reason of the partial sectioning in that figure.

The shoulders define for each cover plate 21, 22 three mutually spaced support points that are engageable by respective feet 41 depending in use downwardly from the undersides of the cover plates 21, 22 adjacent the apices of the approximately triangular shapes they define.

Thus between them the shoulders 39 and the feet 41 provide for non-rocking support of each cover plate 21, 22 when inserted into the frame inside the wall 38.

The larger cover plate 21 is optionally hingedly secured along one edge to the frame 36. Thus the cover plate 21 can be hinged out of the frame 36 to an open position.

Figure 4:
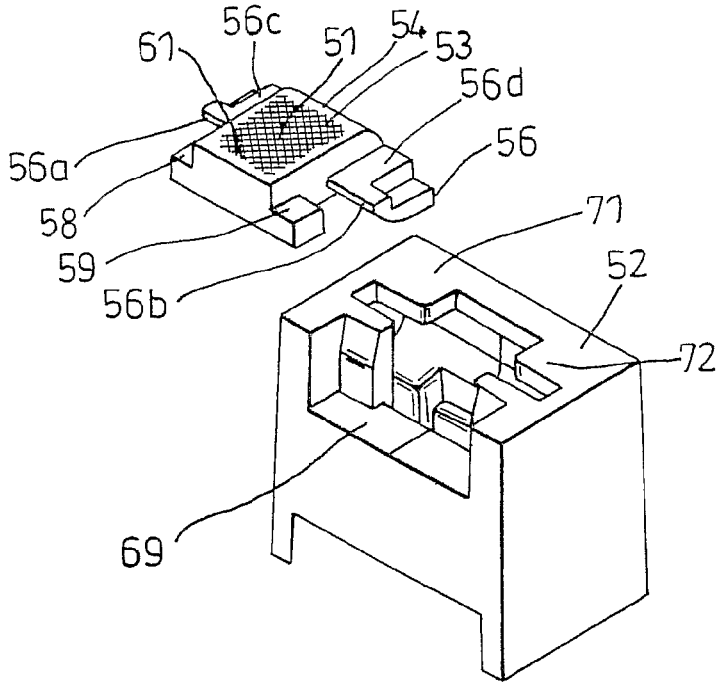
FIGS. 4 to 6 show in perspective view one possible arrangement for hingedly securing one or more cover plates to a frame defining an aperture.
Figure 5:
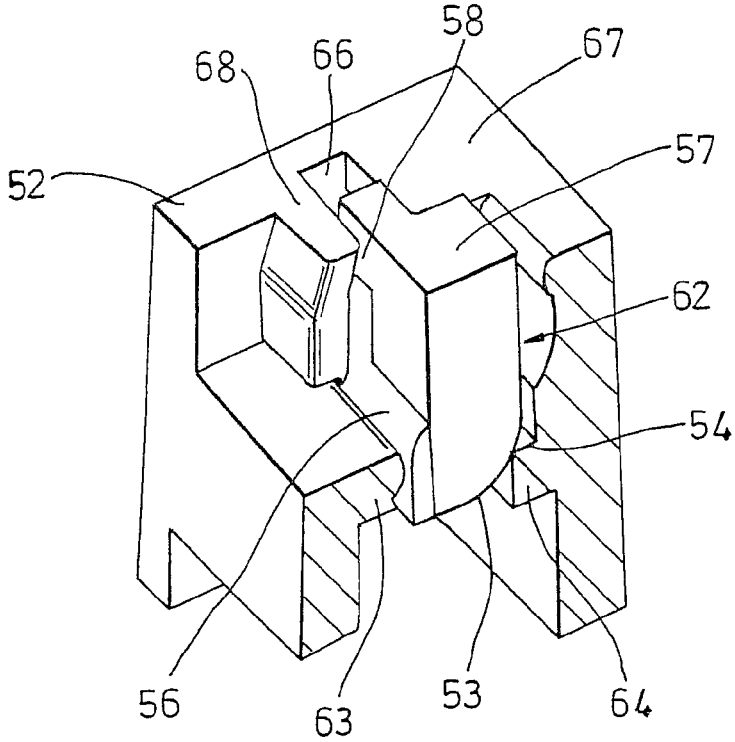
Figure 6:
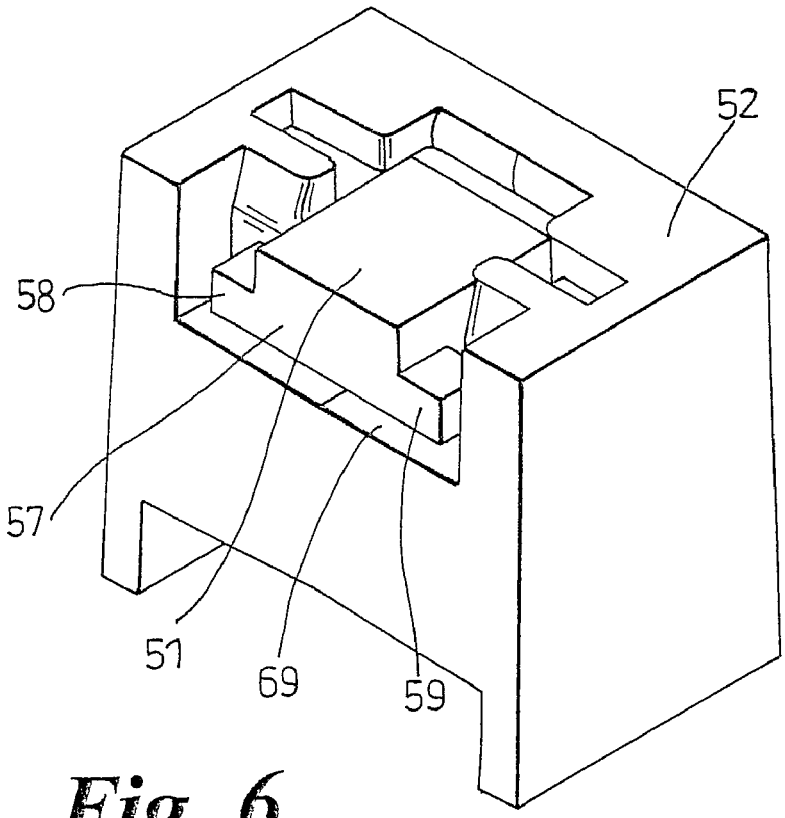

One possible hinging arrangement is shown in FIGS. 4, 5 and 6.

FIG. 4 shows the components of the hinge separated from one another.

A hinge yoke 51, that in FIGS. 4 to 6 is shown separated from a cover plate, is in use secured (eg. by welding or, more preferably, by reason of being cast integrally therewith) to one of the cover plates 21, 22 (preferably the larger cover plate 21).

Hinge yoke 51 is releasably and rotatably receivable in a socket 52 that typically is cast into the wall 38 of frame 36.

As best seen in FIGS. 4 and 5, an in-use lower end 53 of yoke 51 includes on opposite sides axially offset, arcuate bearing surfaces 54, 56.

The bearing surface 54 is a curved undercut formed at the lower end of one side of a plate-like central portion 57 of yoke 51. The bearing surface 56 is constituted by a pair of arcuate surfaces 56*a*, 56*b* formed on the upper shoulders of respective ears 56*c*, 56*d* protruding from either side of central portion 57.

Respective, cuboidal limit members 58, 59 protrude in a similar fashion to the ears 56*c*, 56*d* from an upper end 61 of yoke 51.

As best seen in FIG. 5, which is a vertically sectioned view of the hinge components, socket 52 includes a recess 62 including formations (described below) that co-operate with the yoke 51 when the latter is received in the recess 62.

At its lowermost end recess 62 includes mutually opposite, inwardly protruding wall portions 63, 64 that engage opposite sides of lower end 53 of yoke 51 when the latter is inserted fully into recess 62 in the vertical orientation shown in FIG. 5.

At its uppermost end recess 62 includes at each side a respective, transversely extending pocket 66 defined by a peripheral wall 67 and an inwardly extending wall 68 as shown. When the yoke 51 is inserted as shown in FIG. 5 the pockets 66 engage the cuboidal members 58, 59 to prevent rotation of the hinge.

On lifting of the yoke 51 (by pulling upwardly on the cover plate secured thereto) the cuboidal limit members 58, 59 rise above the top edges of the respective, inwardly extending walls 68. At the same time the lower end 53 of yoke 51 rises above the wall portions 63, 64 and occupies a wider part of socket 62 lying above the wall portions 63, 64.

From this position yoke 51 may either be lifted completely out of socket 62 (as shown in FIG. 4); or it may be rotated so that the limit members 58, 59 pass over the walls 68. During the latter motion the offset bearing surfaces 54, 56 journal in the wider part of recess 62.

Socket 52 includes a transversely extending shoulder 69. Following rotation of yoke 51 as aforesaid the limit members 58, 59 and the part of central portion 57 interconnecting them, engage the shoulder 69. Such engagement limits any further rotation of the yoke 51 relative to the socket 52, such that the yoke 51 is then retained in the horizontal orientation shown in FIG. 6.

The shapes of the yoke 51 and recess 62 are such that when orientated as shown in FIG. 6 the yoke 51 is not liftable out of the socket 62. This is by reason of the lower end 53 of the yoke 51 (when pulled upwardly) engaging protuberances 71, 72 overlying the upper, open end of recess 62, that prevent the bearing surfaces 54, 56 from passing out of the open end of recess 62. Only when yoke 51 is aligned as shown in FIG. 5 does a sufficiently narrow cross section of the yoke 51 coincide with the opening at the upper end of recess 62 as to allow removal of yoke 51 from the recess 62.

The dimensions of the yoke 51 and socket 52 are such that when orientated as shown in FIG. 6 the central portion 57 of yoke 51 lies recessed below the upper edges of socket 52. This allows space for a cover plate secured to central portion 57 when closed to lie flush with the aforesaid upper edges.

In practice for each cover plate that is hingedly secured to the frame there would be provided two of the hinge assemblies as shown, with one at either end of the edge of the respective cover plate lying adjacent frame 36.

The above described hinged securing of the cover plates permits propping of the cover plate 21 in an open position when the yoke occupies the position shown in FIG. 5. In this orientation the yoke 51 and socket 52 co-act to prevent the cover from falling from a vertical towards an horizontal orientation.

If as is preferred the smaller cover plate 22 is hingedly secured to the larger one, it is possible to move both the cover plates at the same time if desired.

When the cover plates 21, 22 are inserted into the frame 36 as shown in FIG. 3 they close off the aperture. In other embodiments of the invention this need not be so. For example perforated cover plates are possible, as are arrangements of the cover plates that do not overlie the entire aperture.

Inspection via the aperture, and the passing of e.g. elongate tools through the aperture, can be carried out with minimum effort by opening only the smaller cover plate 22 to its open position, by hinging it about juxtaposition line 23.

If it is subsequently needed to open the entire aperture, this involves hinging the larger cover plate 21, and with it therefore the smaller cover plate 22 secured thereto, about the hinge retaining the plate 21 captive relative to the frame 36. As noted, removal of the cover plates from the frame is possible, following such hinging.

Closing of the aperture is a reverse of these steps.

Figure 7:
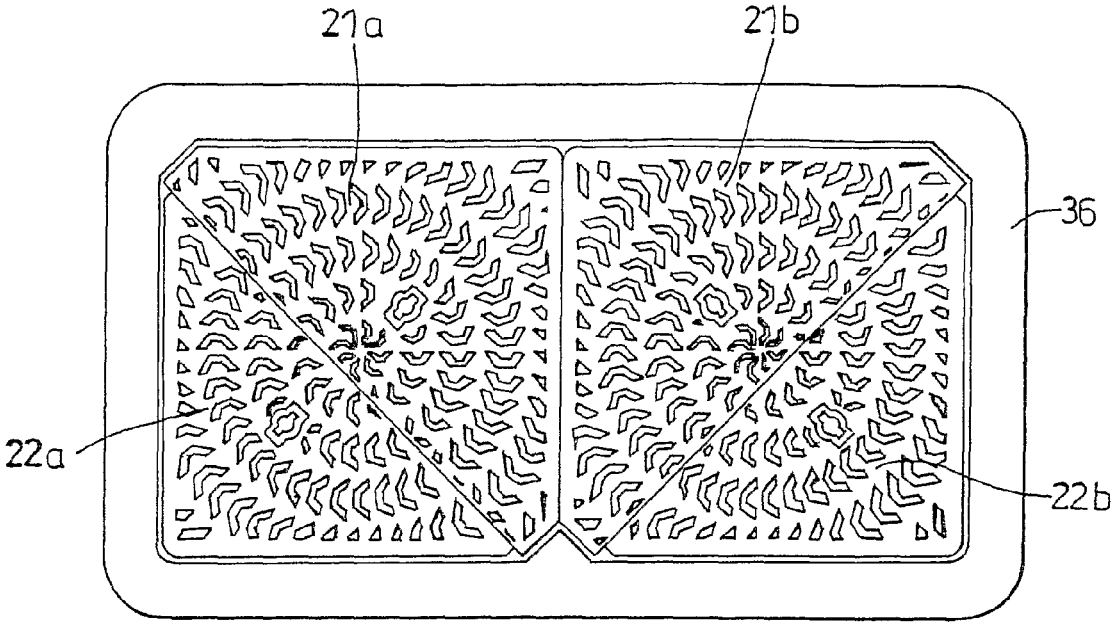
FIGS. 7 to 9 show various preferred embodiments of the invention.

The embodiment shown includes one pair of the cover plates 21, 22. Two of the pairs received side by side in a frame similar to frame 36 may be used to close off a more elongate rectangular aperture. This is shown in FIG. 7, in which the larger cover plates are designated 21*a*, 21*b*; and the smaller ones 22*a*, 22*b*.

Figure 8:
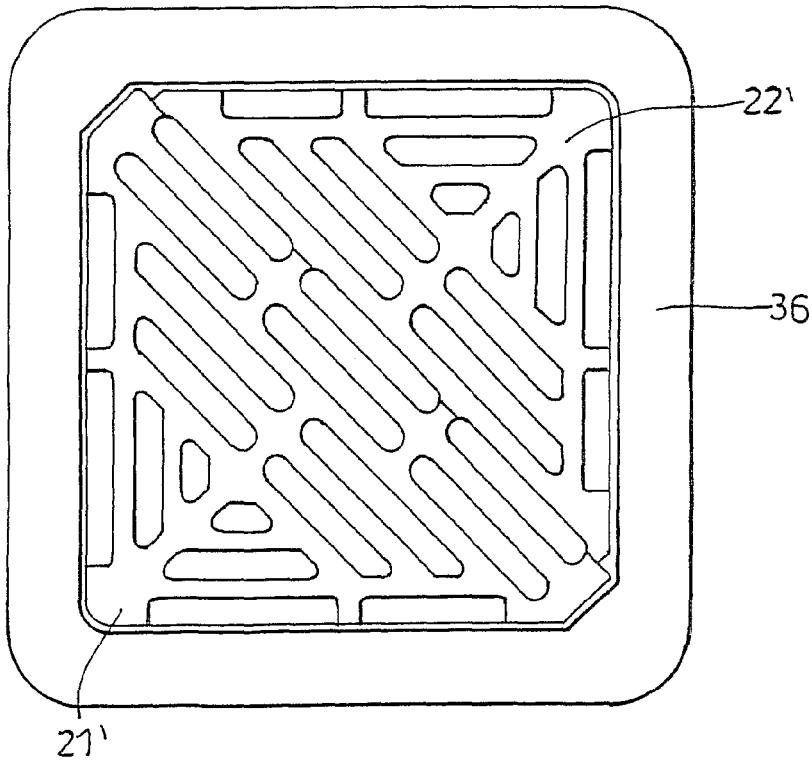
Figure 9:
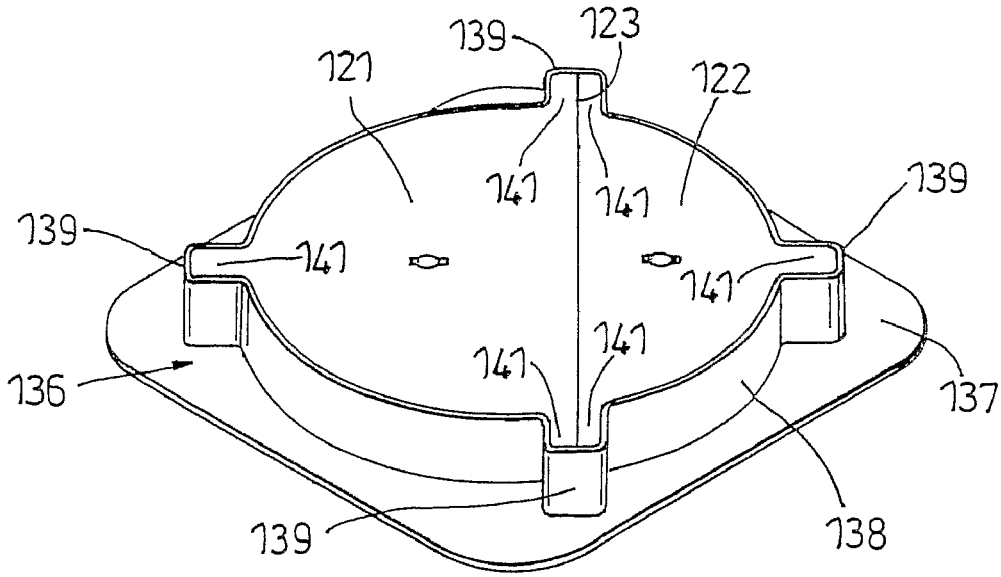

An example of perforated cover plates is shown in FIG. 8 which shows that the principles of the invention are applicable to drainage apertures, whereby the cover plates 21, 22 may if desired be replaced by grilles 21', 22' as shown. FIG. 9 shows another embodiment of the invention, in which the frame (designated 136) while having a conventional, square flange has formed therein a circular aperture defined in part by a generally circular, upstanding wall 138.

In this arrangement the larger and smaller cover plates 121, 122 are each defined by segments of the resulting circular covering. The line of juxtaposition 123 is therefore a chord that does not coincide with the diameter of the circle.

As shown in FIG. 9 the wall 138 may include formed therein four radially outwardly extending, cuboidal recesses 139. The cover plates 121, 122 each include cuboidal projections 141 as shown that occupy the recesses. Thus the projections 141 and the recesses 139 prevent rotation of the cover plates 121, 122 relative to the frame 136; and also provide locations at which hinges and/or locking arrangements may be provided, as desired.

All such arrangements lie within the scope of the invention, not least by reason of including the asymmetric arrangement of primary and auxiliary strengthening members as described herein.

Figure 1:
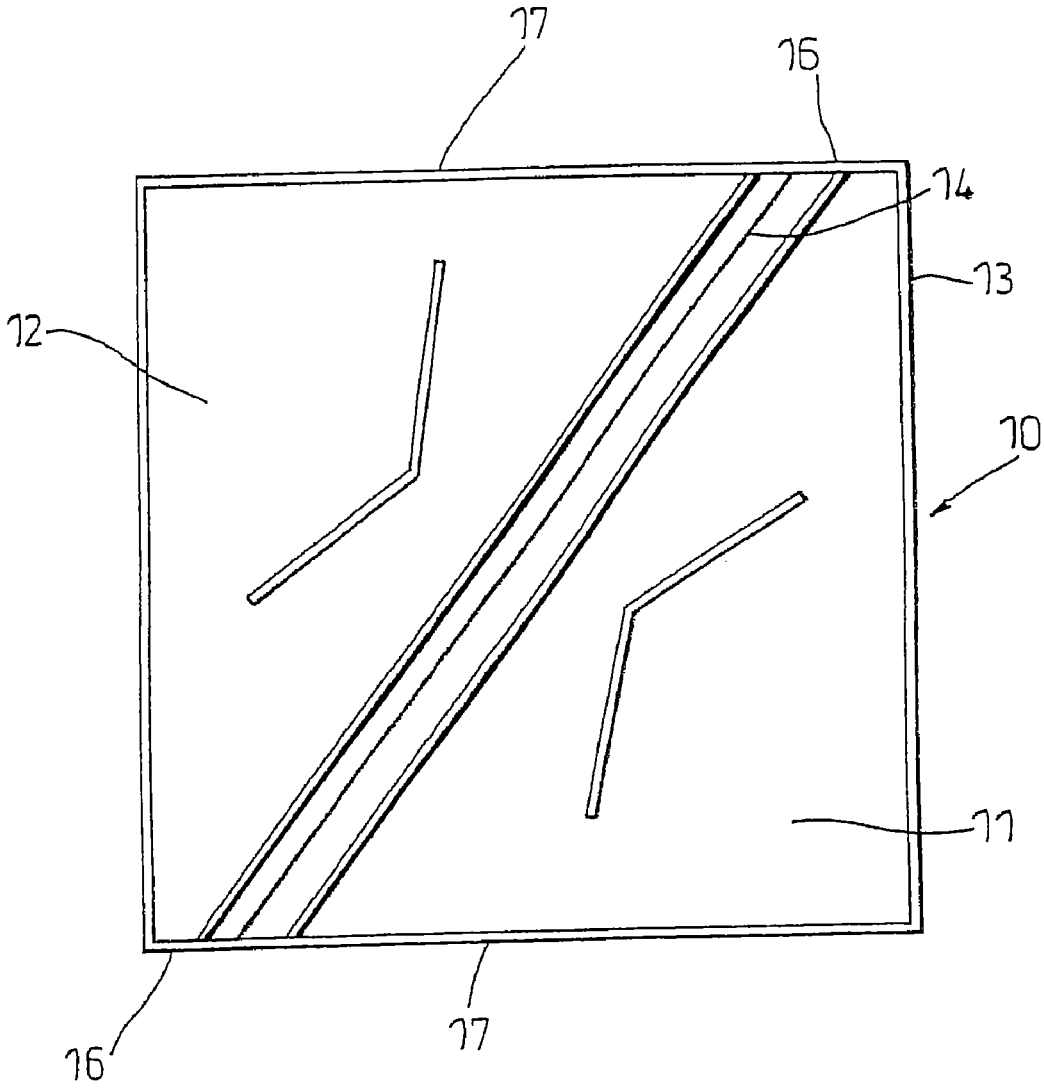
Fig. 1 PRIOR ART
FIG. 1 is a schematic, underneath plan view of a prior art covering and frame assembly.

Also, although the triangular cover plates 21, 22 shown in FIGS. 1 to 3 are particularly suited to being supported using a three-point, non-rocking arrangement, other support arrangements (such as four point support) are possible within the scope of the invention.

Furthermore the cover plates need not be triangular or circular when viewed in plan. Thus it is possible within the scope of the invention for example to provide a series of rectangular cover plates of differing sizes and incorporating the aforesaid asymmetric arrangement of primary and auxiliary strengthening members. Such rectangular cover plates are positionable side by side in a frame, and may if desired be hingedly secured along one or more edges of the frame.

As an alternative to hingedly securing the cover plates to one another, it is possible to omit any connection between the plates; or to connect them by way of a "loose connection". Such connections are known per se.

One form of loose connection is a protuberance formed (eg. by casting) protruding from one of the cover plates, so as to be receivable in a loosely captive manner in a recess in an adjacent cover plate. The shapes of the protuberance and recess can be such as to prevent disconnection of the plates when they are pulled or pushed in one direction; and permit such disengagement when they are pulled or pushed in a different direction.

In another arrangement there may be provided a connection member that is so shaped as to be loosely captively receivable in recesses respectively formed in adjacent cover plates.

The invention claimed is:

1. A manhole covering, for an access aperture, comprising at least a pair of manhole cover plates, of unequal sizes, that are positionable one adjacent the other along a line of juxtaposition to define at least part of the covering, the larger of said pair of cover plates including one or more primary strengthening members and at least a first auxiliary strengthening member of the covering, wherein the primary strengthening member is larger than the auxiliary strengthening member; and the smaller of the pair of cover plates includes at least one primary or auxiliary strengthening member, and wherein each said primary strengthening member extends generally parallel to said line of juxtaposition.

2. A manhole covering according to claim 1 wherein each said strengthening member includes an elongate rib protruding from the in-use underside of said cover plate.

3. A manhole covering according claim 1 or 2, wherein the larger cover plate of said pair includes at least a pair of seats for supporting said cover plate in a frame; and wherein the primary strengthening member substantially interconnects said seats.

4. A manhole covering according to claim 1 or 2, wherein the primary strengthening member lies closer to said line of juxtaposition than to any other edge of the larger of the pair of cover plates.

5. A manhole covering according to claim 1 or 2, including three or more cover plates.

6. A covering according to claim 5 including one or more further lines of juxtaposition along which at least one respective pair of cover plates are positionable one adjacent the other.

7. A manhole covering according to claim 1 or 2, the cover plates of which, when positioned one adjacent the other along one or more lines of juxtaposition as appropriate, define a rectangular covering.

8. A manhole covering according to claim 7 including a line of juxtaposition that is a straight line intersecting two adjacent sides of the rectangular covering defined by the cover plates.

9. A manhole covering according to claim 7 including a line of juxtaposition that intersects a diagonal of the rectangular covering.

10. A manhole covering according to claim 7 including a line of juxtaposition that is spaced from the diagonal, of the rectangular covering, that it is proximate.

11. A manhole covering according to claim 1 or 2, wherein the larger of the pair of cover plates includes two strengthening members; and the smaller of the pair includes a single strengthening member.

12. A manhole covering according to claim 1 or 2 including a connection securing the cover plates of the pair one to the other.

13. A manhole covering according to claim 12 wherein the connection permits pivoting of the plates along the line of juxtaposition.

14. A surface access assembly including a frame defining the boundary of an aperture; and a manhole covering according to claim 2, the covering being moveably receivable in the frame so as to permit closing and opening of the aperture.

15. An assembly according to claim 14 including a hinge pivotably securing one of said cover plates to the frame.

16. An assembly according to claim 14 or claim 15, wherein the frame and each said cover plate engage one another at three mutually spaced locations so as to define a non-rocking support for each cover plate.

17. An access assembly according to claim 14, wherein the aperture is rectangular; and the direction of elongation of the primary strengthening member generally coincides with a diagonal of the rectangular aperture.

* * * * *